US007632045B2

(12) United States Patent
Wu et al.

(10) Patent No.: US 7,632,045 B2
(45) Date of Patent: Dec. 15, 2009

(54) DETACHABLE ANCHOR BOLT MIXING HEAD FOR USE IN MINE ROOF SUPPORT SYSTEMS AND METHOD OF USING SAME

(75) Inventors: Yaokun Wu, Sudbury (CA); Denis Champaigne, Copper Cliff (CA)

(73) Assignee: Mansour Mining Inc., Sudbury, Ontario (CA)

( * ) Notice: Subject to any disclaimer, the term of this patent is extended or adjusted under 35 U.S.C. 154(b) by 247 days.

(21) Appl. No.: 11/730,661

(22) Filed: Apr. 3, 2007

(65) Prior Publication Data

US 2007/0243026 A1 Oct. 18, 2007

(51) Int. Cl.
*E21D 20/00* (2006.01)

(52) U.S. Cl. ..... 405/259.1; 405/259.5

(58) Field of Classification Search ..... 405/259.1, 405/259.2, 259.4, 259.5, 262, 266
See application file for complete search history.

(56) References Cited

U.S. PATENT DOCUMENTS

| | | | | |
|---|---|---|---|---|
| 4,673,320 | A * | 6/1987 | Froehlich | 411/21 |
| 5,531,143 | A * | 7/1996 | Habermehl et al. | 81/438 |
| 6,390,735 | B1 * | 5/2002 | Gaudreau et al. | 405/259.6 |

FOREIGN PATENT DOCUMENTS

| | | |
|---|---|---|
| CA | 2439397 | 8/2003 |
| CA | 2444192 | 10/2003 |
| CA | 2506342 | 5/2005 |

* cited by examiner

*Primary Examiner*—David J Bagnell
*Assistant Examiner*—Benjamin Fiorello

(57) ABSTRACT

A mixing head attachment is provided for use in mixing grouts and/or resins (hereinafter for brevity collectively referred to as resin) used in mine roof support systems in the securement of an anchor bolt in a bore hole. A threaded fastener is provided to tension the anchor bolt, and a resin composition is used to secure at least part of the anchor rod in the bore hole. The mixing head attachment is provided with a rigid or semi-rigid body which extends axially along a body axis, and has sufficient structural integrity to effect mixing of unset resin as the mixing head is rotated about its axis. The mixing head attachment includes one or more mixing blades or projections which define a mixing surface or face. A recess is formed in a proximal-most end of the body, sized and shaped for mated engagement with a distal end of the anchor bolt, allowing mixing head attachment to be in generally co-axial arrangement to the anchor bolt with a sufficient minimum contact force selected so that while the resin remains unset, the rotation or spinning of the anchor rod in the bore hole effects rotation of the mixing attachment about its axis therewith.

23 Claims, 6 Drawing Sheets

DETACHABLE ANCHOR BOLT MIXING HEAD FOR USE IN MINE ROOF SUPPORT SYSTEMS AND METHOD OF USING SAME

SCOPE OF THE INVENTION

The present invention relates to a mixing head attachment adapted for use with anchor bolts used in mine and wall support systems, and more particularly a mixing head which may be quickly and easily attached to the end of an anchor bolt prior to its insertion in a bore hole to achieve enhanced and more efficient mixing of resin or grout used to secure the anchor bolt in place.

BACKGROUND OF THE INVENTION

In concrete wall, mine roof and rock wall support systems (hereinafter collectively generally referred to as "mine roof support systems"), it is known to embed longitudinally elongated rod-like reinforcing rebars or anchor bolts within drill holes ranging from 25 mm to 45 mm which have been drilled in the wall or rock face. Typically, a number of grout or two-part resin cartridges are pre-inserted into the bore hole ahead of the anchor bolt. The reinforcing anchor bolts each comprise a four to twelve foot length of steel which is threaded along its outermost proximal end. The bolts are inserted into the drill or bore hole, so that the threaded end projects outwardly beyond the wall or rock face, permitting the threaded coupling of a nut thereto. Once inserted into the drill hole, the bolt is spun or rotated about its longitudinal axis, while it is slowly inserted into the resin or cement cartridge, to assist in mixing the grout or resin, securing it in place.

To spin the rod, a nut or threaded fastener is coupled to the proximal end of the bolt, and which following setting of the resin, is tightened against the wall or rock face to consolidate forces, and prevent or control ground movement. Frequently, the torquing nut consists of a dome nut having a deformable end cover, threaded onto the anchor rod and used to rotate the bolt and thus aid in resin mixing. Conventional cast dome nuts typically are formed having a threaded socket which extends into a domed end portion. The domed end portion is formed with a thickness such that its engagement with the end tip of the bolt prevents further movement of the dome nut onto the bolt end under initial torque forces, with the result that the bolt rotates together with the turning of the dome nut. As the grout/resin sets, resistance to the rotation of the bolt increases. As the rotational torque forces applied to the nut exceed a critical minimum or threshold rotational torque force, the domed end portion of the nut splits apart by the contact pressure forces of the bolt end thereagainst, allowing the nut to be tightened along the bolt and against the rock face. Another torquing nut employed is a pin nut. This consists typically of a 1.125" square nut threaded onto the end of the bolt threaded section and a small drill hole, typically 5/16", is machined through both the nut and bolt. A pin such as a 5/16" roll pin is inserted into the drill hole on the side of the nut. The pin nut prevents the advancement of the nut while it is mixing the two part resin cartridge. Once the resin has set up or hardened, the rotational torque forces applied the nut exceeds a critical minimum rotational force required to shear the roll pin, split pin or solid pin, thus allowing the nut to travel along the treaded section and apply load the rock face.

In certain mine roof support applications, it is desirable to provide an anchor rod or bolt which is constructed so as to yield, whereby the bolt is moved axially along the bore hole through set grout or resin, to assist in absorbing either static or dynamic ground forces. With such yieldable anchor bolts, forces generated by dilating rock are transferred to the anchor bolt via the tightened nut. As the rock forces reach a predetermined minimum yield force, the yieldable anchor bolt is partially drawn outwardly from the bore hole, moving axially through the anchoring resin, thereby absorbing the force from the surrounding rock and returning the system to a state of equilibrium. International Publication No. WO 02/02910 A2 to Gaudreau, published Jan. 10, 2002, describes one such yieldable cone bolt construction, used as a reinforcing rod in mine roof support systems. The cone bolt described in Gaudreau consists of a steel bar which has a conical wedge-shaped projection at its inner distal end, and which extends radially to a diameter of about 2.5 mm. A 2 to 2.5 cm long mixing tab is mounted to the end of the conical projection for use in assisting in the mixing of resin used in the initial securement of the cone bolt in the bore hole.

Conventional yieldable cone bolts suffer a disadvantage in that heretofore, their construction has been poorly suited to achieve even mixing of the anchoring resin. In particular, even where a mixing tongue or blade is provided, to ensure that the blade does not interfere with the axial movement of the bolt when yielding, it is necessary to manufacture the bolts so that the blade has a maximum diameter no larger than that of the enlarged cone projection, and which, in use, is typically about ⅔ the diameter of the bore hole. In particular, heretofore the radial diameter of mixing blades has been largely kept no larger than that of the enlarged conical projection where it may otherwise interfere with the yielding movement of the cone bolt upon the application of a minimum yield force thereto. As a result, (the narrower dimension of) the mixing blade relative to the bolt hole often results in the incomplete mixing of resin, particularly in the areas immediately adjacent to the bore hole walls. This in turn may result in incompletely mixed resin along the bore hole sidewalls, which could result in inconsistent, unpredictable or unreliable yielding of the anchored bolt.

SUMMARY OF THE INVENTION

To at least partially overcome at least some of the disadvantages associated with prior art wall and mine roof support systems, the present invention seeks to provide a mixing head attachment which may be quickly and easily attached to the distalmost end of an anchor rod or bolt used in either conventional concrete wall, rock wall or mine roof support systems, and which is configured to effect enhanced and more complete static mixing of the resin or cement matrix (reduced mixing rotational speed as it is spun through the resin matrix) and resin mixing as the anchor bolt is initially spun through the resin or grout in a conventional manner. The mixing head advantageously allows more thorough mixing of the resin/cement in oversized drilled hole. Oversizing occurs in weak or highly stressed rock. It can range from 0.1 mm all the way to 5 mm over the drill bit's diameter. The mixing head preferably also serves to centralize the conical end of the bolt in the resin or cement matrix of the drilled hole. This ensures full encapsulation around the cone section.

In another aspect, the present invention seeks to provide a mixing head attachment which may be either permanently, or more preferably detachably, secured to the distal end of an anchor rod or bolt used in mine roof support systems.

Another object of the invention is to provide a resin mixing attachment for use in conjunction with a yieldable cone bolt as part of a mine roof support system, and which is adapted to be engaged by the inner distalmost end of the cone bolt so as to be rotatable therewith, but which otherwise does not prevent yielding movement of the cone bolt following the application of a predetermined minimum yield force thereon.

A further object of the invention is to provide a mixing head attachment for use with an anchor rod or bolt which has at its distalmost end an axially projecting tongue or blade tab member or the like, which is sized for mated insertion within a complementary shaped socket formed in a proximal end of the mixing head attachment.

Another object of the invention is to provide in a mine roof bolt system, a mixing head which is adapted for attachment to the distal end of an anchor rod or bolt for mixing grout or resin as the bolt is spun, and which has a minimum radial diameter of ⅔ the hole diameter up to a maximum radial diameter of at least 80%, and more preferably at least 90% of that of the bore hole, to achieve more even mixing of grout or resin along the circumferal portions of the bore hole sidewall. This mixing head will allow increased mixing of the resin or grout through a combination of static mixing through straight insertion of the bolt and rotational mixing from spinning the bolt on insertion.

A mixing head attachment is provided for use in mixing grouts and/or resins (hereinafter for brevity collectively referred to as resin) used in mine roof support systems in the securement of an anchor bolt in a bore hole. The mine roof support system may be used with a variety of diameter bore holes including diameters at between about 2 and 8 cm, and preferably between 2.5 and 5 cm. A threaded fastener is used to tension the anchor bolt, and a resin composition is used to secure at least part of the anchor rod in the bore hole. The threaded end of the anchor bolt is adapted to be engaged by the threaded fastener. In one possible embodiment, the fastener may comprise a metal nut having a generally dome shaped end which is configured to deform or detach following the application of a predetermined minimum torque on the nut. Other nut configurations may, however, equally be used such as a pin nut.

The mixing head may be used with a variety of different types of anchor rods and bolts used in wall, rock and mine roof support systems including, without restriction, conventional threaded rebar, yieldable anchor rods and strand bolts. In a most simplified construction, the mixing head is provided with a rigid or semi-rigid body which extends axially along a body axis. The body of the mixing head is provided with sufficient structural integrity to effect mixing of unset resin as the mixing head is rotated about its axis. Most preferably, the body of the mixing head is constructed to avoid significant deformation upon the application of rotational torque forces thereon of between about 10 and 220 ft/lbs and more preferably about 30 to 160 ft/lbs. The mixing head includes one or more mixing blades or other projections which define a respective mixing surface or face. The mixing blades or projections may have a variety of configurations, and by way of non-limiting example may be provided as tabs, fins, spikes, posts, or the like which project radially from the body axis. The blades or projections may be of a rigid or semi-rigid construction which is selected so as to achieve enhanced resin mixing, as the body is rotated. Preferably, one or more recesses are formed in a proximal-most end of the body which is sized and shaped for mated engagement with a distal end of the anchor bolt. The recess is used to couple the mixing head in generally co-axial arrangement with the anchor bolt with a sufficient minimum contact force selected so that while the resin remains unset, the rotation or spinning of the anchor rod in the bore hole effects rotation of the mixing head about its axis therewith.

The mixing head attachment may be either releasably coupled to the anchor rod, or permanently attached thereto. Where the mixing head attachment is permanently secured in place, adhesives, weldments, rivets, threads or other mechanical fasteners may be used.

Although not essential, most preferably the mixing head attachment is provided for use in mine roof support systems which incorporate yieldable cone bolts having one or more cone-shaped or frustoconical protuberances, and at least one axially extending distalmost projection or tongue.

When used with yieldable cone bolts, the mixing head preferably is provided as a detachable mixing head which is adapted to permit selective axial movement between the mixing head and the cone bolt, so as to not substantially interfere with axial yielding movement of the bolt following the application of a predetermined minimum yield force or rockburst thereon. A rockburst is a seismic event whereas the rock face is projected from the surface of the rock. Preferably, the mixing attachment has a radial diameter at least equal to and more preferably greater than that of the enlarged cone-shaped protuberances. In a most preferred configuration, the mixing head has a maximum radial extent of at least 80%, and more preferably at least 90% as wide as the radial diameter of the bore hole, so that as the mixing head is rotated about the body axis, at least one of the mixing blades or protuberances is moved in circumferential movement in immediate proximity to the bore hole sidewall.

The cone bolt may comprise a metal or forged steel cone bolt which is elongated along a bolt axis with the cone-shaped or frustoconical protuberances at its distalmost end. The tongue or blade may be provided with a variety of possible cross-sectional shapes, including profiles which may include square, rectangular, crescent-shaped, semi-circular, or an oval. Preferably, however, the tongue is provided with a generally cross-shaped cross-sectional shape, so as to present contact surfaces extending normal to each other. The recesses formed in the body are most preferably selected for complementary engagement with the cone bolt tongues or blades, and more preferably are formed with a direct complementary cross-sectional profile, whereby insertion of the tongue or blade into the recess retains the mixing head on the distal end of the anchor bolt in co-axial alignment thereon in a friction fit. The mated engagement between the tongue or blade and the mixing head recess and the structural rigidity of the mixing head body advantageously assist in fixedly retaining the cone bolt against rotational torque forces applied thereto by the tightening of the nut following the curing of the resin.

It is to be appreciated that the resin mixing head attachment may be provided as a separate mixing tool to increase the mixing ability of the system and improve the mixing effect of the bolt. In use, it is plugged on the tongue or blade of the cone bolt and pushed into the drill hole together with the bolt. The mixing head is rotated together with the bolt as the bolt is spun during installation, to break resin cartridges and mix the resin. After the resin has set up, the body of the mixing head provides enough torque resistance for tensioning of the bolt. When the bolt yields or pulls through resin, the blade or tongue will detach from the mixing head, leaving the mixing head in its original location.

Accordingly, in one aspect the present invention resides in a mixing attachment for use in mixing resin used in the securement of an anchor bolt in a bore hole, the attachment member comprising, a body extending longitudinally along an axis from a first end portion to a second end portion, and including, at least one blade member, including at least one associated mixing face extending generally radially relative to said axis, said mixing face configured to assist in mixing said resin as said mixing attachment is rotated about said axis, a recess formed in said second end portion sized for complementary mated engagement with a distal end of said anchor bolt, said recess configured to couple said mixing attachment to said distal end with a minimum contact force selected so that prior to the setting of said resin, the rotation of the anchor rod in said bore hole effects rotation of said mixing attachment about said axis.

In another aspect, the present invention resides in a mine roof support assembly for use in a predrilled bore hole having a diameter selected at between 2 and 6 cm, the assembly comprising, an anchor bolt comprising a longitudinally elongated member which extends along a bolt axis from a threaded proximal end portion to a distal end portion, and further including a mid-portion intermediate said proximal and distal end portions, the distal end portion including a frustoconical wedge member extending radially outwardly relative the bolt axis from a reduced diameter proximal-most end to an enlarged diameter distal-most end, and a tongue member, a threaded fastener including, a fastener body having first and second ends, a generally cylindrical opening extending through said fastener body, internal threads being provided along at least a portion of said opening, the internal threads sized for threaded engagement with the externally threaded proximal end portion of the anchor bolt, whereby the relative rotational movement of the threaded fastener and the anchor bolt moves the threaded fastener axially along the anchor bolt, a retaining member for limiting axial movement of the threaded fastener relative to said anchor bolt from a first position up to a predetermined rotational torque, said retaining member at least partially obstructing said cylindrical opening to limit relative movement of said fastener along said proximal end portion, and a resin mixing head comprising a head body extending longitudinally along a head axis from a first end portion to a second end portion, and including, a plurality of blade members, said blade members including a respecting mixing face extending generally radially relative to said head axis and configured to assist in mixing resin in said bore hole as said mixing head is rotated about said head axis, a recess formed in said second end portion sized for engagement with said tongue member of said anchor bolt, said recess configured to couple said mixing head to said anchor bolt so as to be rotatable therewith about said head axis upon the application of rotational torque forces on said anchor bolt up to said predetermined rotational torque, while permitting relative axial movement between said head body and said anchor bolt in the event of a predetermined minimum yield force.

In a further aspect, the present invention resides in the combination of an axially elongated anchor member and a mixing head for use in mixing resin used in the securement of an inner distal end portion of the anchor member in a bore hole, the mixing head comprising, a body extending longitudinally along an axis from a first end portion to a second end portion, and including a plurality of blade members, each blade member including a mixing face projecting generally outwardly relative to said axis and configured to assist in mixing said resin as said mixing head is rotated, a recess formed in said second end portion sized for complementary mated engagement with said distal end portion of said anchor member, said recess configured to couple said mixing head to said anchor member in generally co-axial alignment with sufficient contact force so as to be rotatable therewith about said axis under relative torque rotational forces of at least about 20 ft/lbs.

BRIEF DESCRIPTION OF THE DRAWINGS

Reference may now be had to the following detailed description taken together with the accompanying drawings in which.

DETAILED DESCRIPTION OF THE PREFERRED EMBODIMENTS

Figure 6:
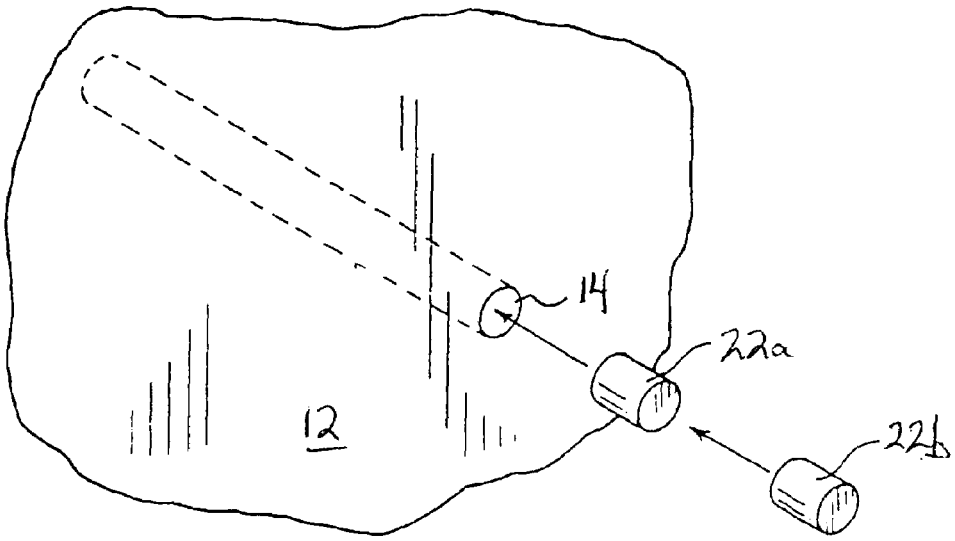
FIG. 6 shows schematically an exploded view of a predrilled bore hole formed in a rock complex, illustrating the initial placement of resin cartridges therein in the installation of the mine roof support system in accordance with the preferred embodiment.
Figure 7:
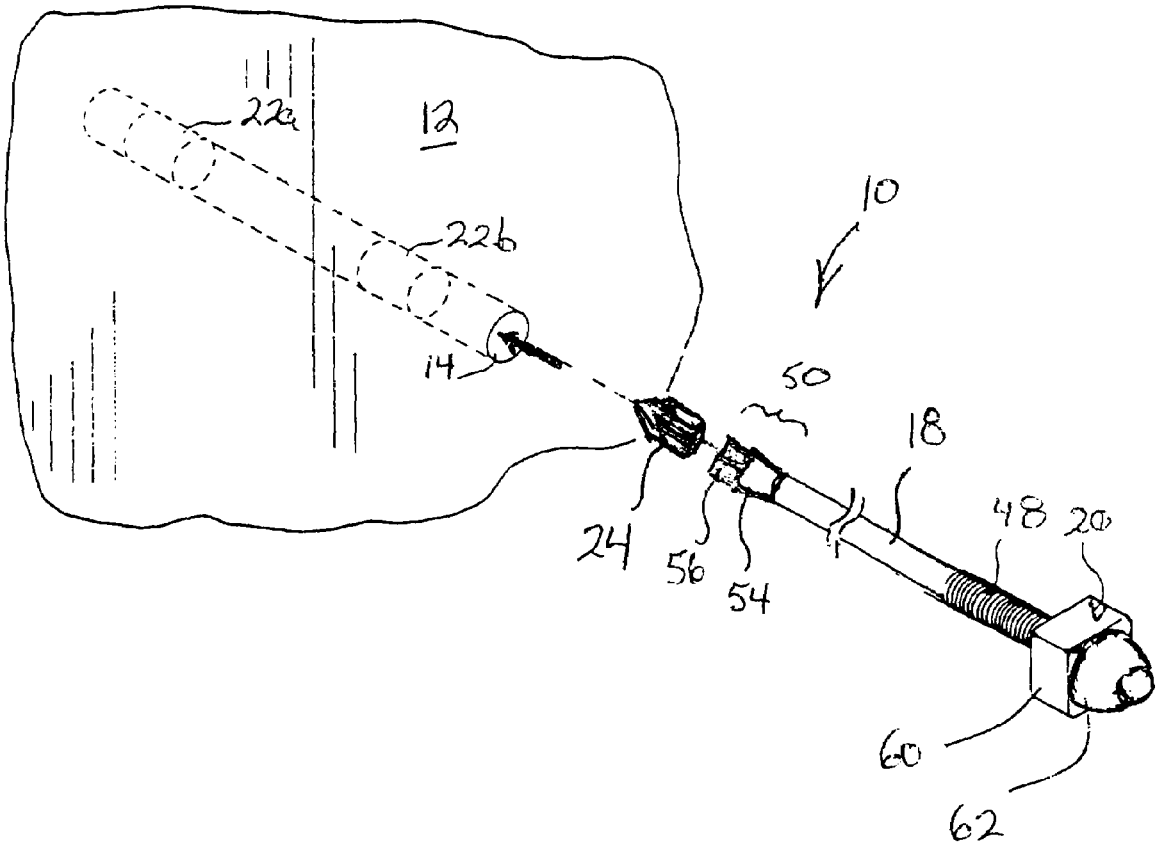
FIG. 7 shows a perspective view of the rock complex of FIG. 6 illustrating the manner of inserting the mixing head of FIG. 1 and cone bolt of FIG. 4 in the bore hole, following placement of the resin cartridges.
Figure 8:
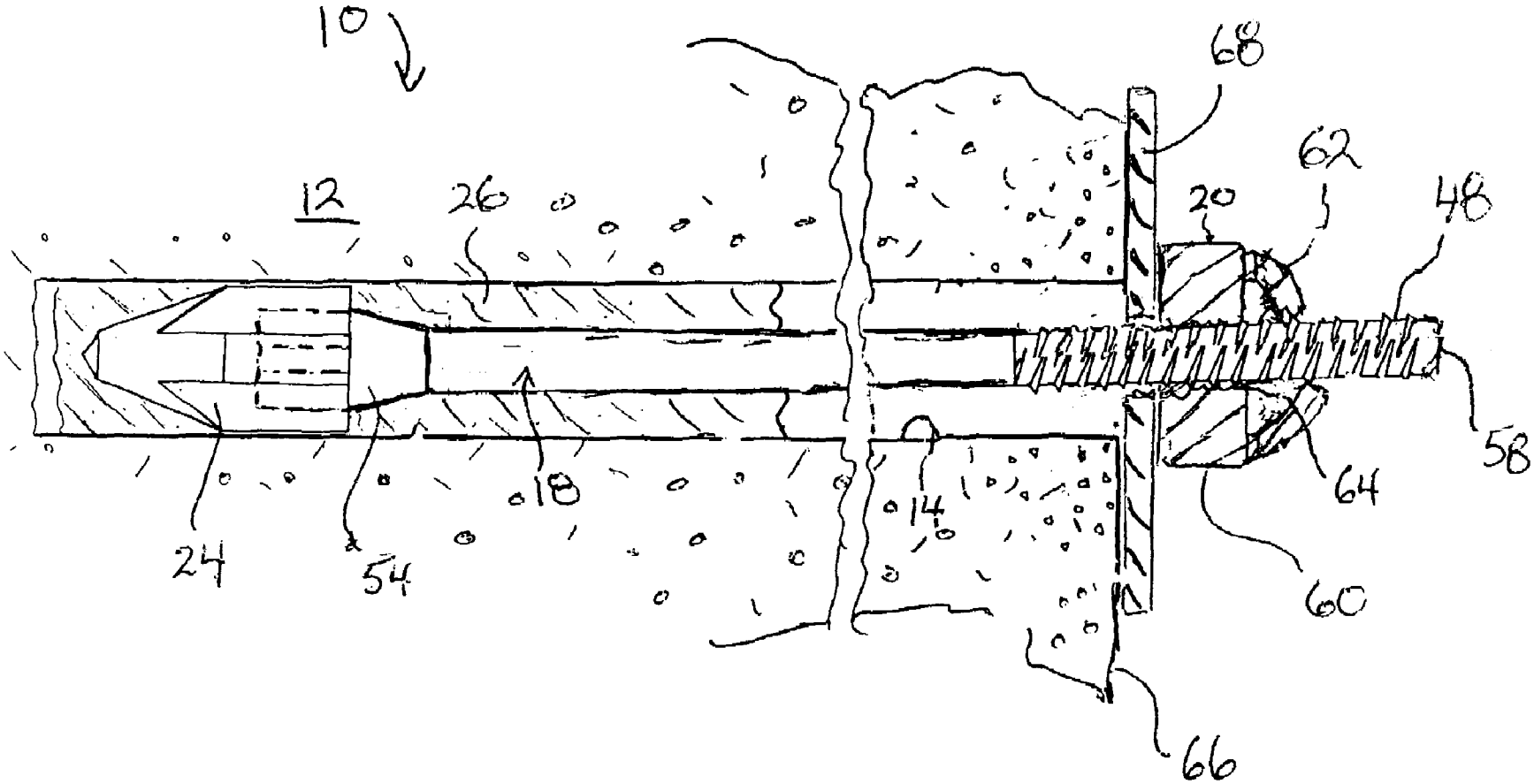
FIG. 8 shows a partial cross-sectional view of the rock complex and mine roof support system illustrating the cone bolt in an initial fully inserted position, with the nut tightened in the set resin to consolidate rock forces.

The present invention relates to a yieldable mine roof support system 10 which, as shown best in FIGS. 6 and 8, is adapted to absorb energy forces generated by dilating rock in a rock complex 12. Depending upon the site of installation and geology, a 2 to 10 cm diameter bore hole 14 is drilled into the rock complex 12 to a depth of between about 1.5 and 2.5 meters. FIGS. 6 to 8 shown the mine roof support system 10 used to reinforce the rock complex 12 as including a steel cone bolt 18, a cast steel dome nut 20, a number of multi-part resin cartridges 22*a*, 22*b*, each of which carry a volume of unmixed two-part low viscosity resin 26 (FIG. 8), and a detachable resin mixing head 24. As will be described, the resin mixing head 24 operates in conjunction with the bolt 18 and dome nut 20 to pierce the resin cartridge 22*a*, 22*b* and achieve better mixing of unset anchoring resin (shown as 26 in FIG. 9) within the bore hole 14.

Figure 1:
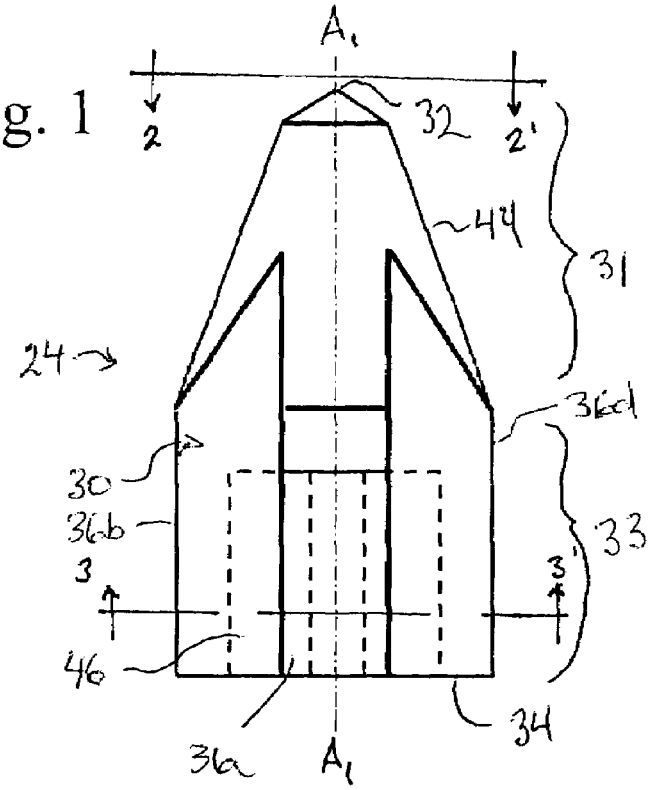
FIG. 1 shows a schematic side view of a resin mixing head for use in a mine roof support system in accordance with a preferred embodiment of the invention.
Figure 2:
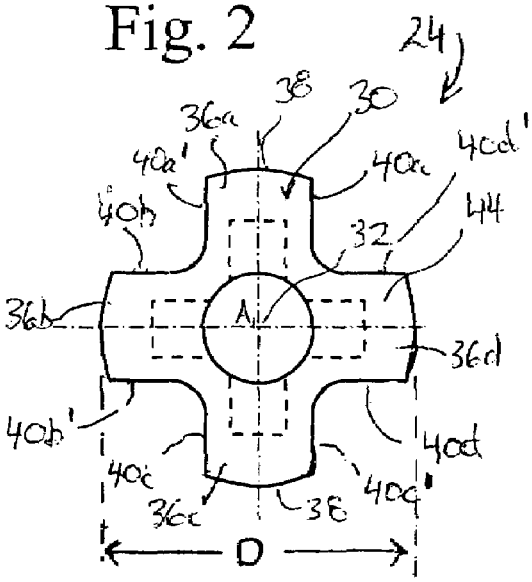
FIG. 2 shows a schematic top view of the mixing head shown in FIG. 1 along lines 2-2.
Figure 3:
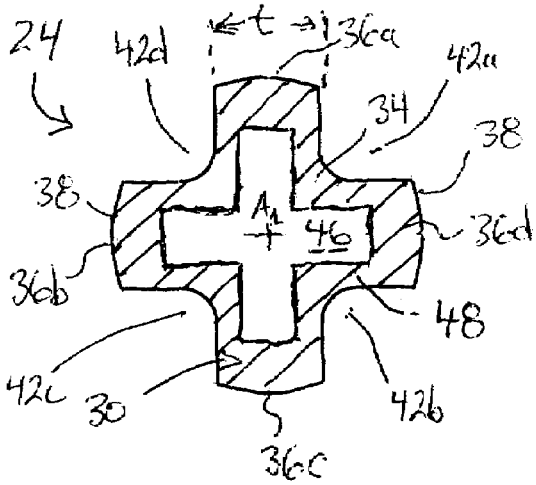
FIG. 3 shows a cross-sectional view of the mixing head shown in FIG. 1 taken along lines 3-3.

FIGS. 1 to 3 show best the mixing head 24 which in a most preferred construction is formed having an integral cast aluminum body 30. The body 30 is elongated along a longitudinal body axis $A_1$-$A_1$, extending from an axially centred distalmost apical tip 32 to a proximalmost end surface 34 which extends radially outwardly and generally normal to the axis $A_1$-$A_1$.

FIG. 1 shows best the mixing head body 30 as comprising a first distal portion 31, and a second proximal portion 33. The distal portion 31 extends from the apical tip 32 and merges gradually with the proximal portion 33 along ¼ to ½ the axial length of the body 30. Although not essential, most preferably the first distal portion 31 of the mixing head 24 is provided with a generally cone shaped surface 44 which tapers radially outwardly towards the end surface 34. The tapered cone shaped surface 44 advantageously assists in the use of the mixing head 24 to pierce and rupture the resin cartridges 22*a*, 22*b*, In addition, the cone-shaped surface 44 facilitates the insertion of the mixing head 24 and the cone bolt 18 into the bore hole 14, and furthermore advantageously assisting in orientating the mixing head 24 centrally within the bore hole 14 in co-axial alignment therewith.

The proximal portion 33 of the body 30 is shown best in FIG. 2 as being formed with a generally cylindrical geometry centred about the axis $A_1$-$A_1$, having an axial length of between about 4 and 12 cm, preferably 5 and 10 cm. The body 30 extends from the axis $A_1$-$A_1$ by a maximum radial distance selected at least 80% and more preferably at least 90% of the radius of the bore hole 14. The body 30 is constructed to define integral therewith four identical radially projecting fins or blades 36*a*, 36*b*, 36*c*, 36*d*. Each of the blades 36*a*, 36*b*, 36*c*, 36*d* are equally radially spaced from each other about the axis $A_1$-$A_1$. The blades 36*a*, 36*b*, 36*c*, 36*d* extend outwardly to a respective curved outermost surface 38, which merges at each edge respectively with a pair of parallel generally planar mixing faces 40*a*, 40'*a*, 40*b*, 40'*b*, 40*c*, 40'*c*, 40*d*, 40'*d*. The planes of the mixing faces 40*a*, 40'*a*, 40*b*, 40'*b*, 40*c*, 40'*c*, 40*d*, 40'*d* extend generally parallel to the axis $A_1$-$A_1$. Most preferably, the blades 36*a*, 36*b*, 36*c*, 36*d* extend radially from the axis $A_1$-$A_1$ so as to provide the mixing head body 24 with a maximum radial diameter D (FIG. 2) which is selected at between about 90 and 99% of the diameter of the bore hole 14.

The radial thickness (t) of the mixing blades 40*a-d* is chosen to provide the blades 40 with sufficient structural rigidity to ensure adequate mixing of the unset resin 26 as the body 30 is rotated. The blades 36*a-d* preferably have a thickness t separating the respective parallel mixing faces 40,40' selected at between about 0.5 and 1 cm. In addition, the blades 40 preferably have sufficient thickness to provide adequate torque resistance against the resin 26 so that when cured, the fracture of the mixing blades 40, resulting in further possible rotation of the mixing head 24 relative to cured resin 26, is unlikely to occur. The radial spacing of the mixing blades 40*a*, 40*b*, 40*c*, 40*d* defines therebetween respectively resin flow channels 42*a*, 42*b*, 42*c*, 42*d* (FIG. 3). The resin flow channels 42*a*, 42*b*, 42*c*, 42*d* extend axially from the conical first distal portion 31 to the end surface 34 and advantageously allow substantially unhindered flow of unset resin axially along the bore hole 14. This enables resin flow past the mixing head 24 as it is inserted and rotated, ensuring the unrestricted flow of resin 26 about the cone bolt 18. Other mixing blade constructions and resin flow channel configurations, however, may also be used and will now become apparent.

As shown best in FIGS. 1 and 3, a socket 46 extends axially inward from the proximal end surface 34 of the body. The socket 46 is provided with a generally cross-shaped lateral cross-sectional shape and preferably extends inwardly an axial distance of at least 1 cm, and more preferably approximately 2 to 3 cm into the body. As shown best in FIG. 3, the socket 46 is defined by a surrounding sidewall portion 48 of the body 30. The sidewall portion 48 is selected with a thickness, having regard to the material used to form the body 24 so as to provide the desired rotational torque resistance to the cone bolt 18 following the setting of the resin 26. As will be described hereafter, the socket 46 is used to detachably couple the mixing head 24 in place in co-axial alignment with a distalmost inner end portion 50 (FIG. 4) of the cone bolt 18. The mated engagement between the socket 46 and end portion 50 substantially prevents relative rotation of the mixing head 24 and bolt 18 under rotational torque forces of less than at least 200 ft/lbs, and more preferably 40 to 165 ft/lbs, while permitting relative axial movement between the mixing head 24 and cone bolt 18 in the event of a predetermined minimum yield force thereon.

Figure 4:
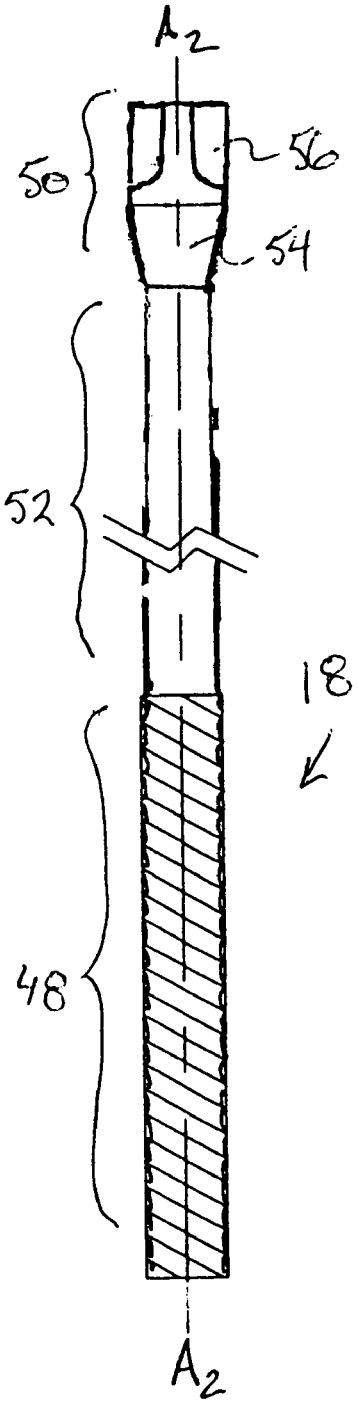
FIG. 4 shows a partial perspective side view of a cone bolt for use with the mixing head of FIG. 1.

FIG. 4 shows best the cone bolt 18 for use in the mine support system 10. The bolt 18 is elongated along a longitudinal bolt axis $A_2$-$A_2$, and extends from an externally threaded proximal end portion 48 to the distalmost end portion 50 and proximal end portion 48, and which are connected by an integrally formed cylindrical steel mid-portion 52. The cone bolt 18 extends axially along the axis $A_2$-$A_2$ with an overall length selected at between about 1.5 and 2.5 meters, depending upon the depth to which the bore hole 14 is drilled into the rock complex 12. The cone bolt 18 has an overall length selected so that when fully inserted in the manner shown in FIG. 8, the proximal threaded end portion 48 projects a distance of about between 10 and 40 cm outwardly past the face of the rock complex 12. Preferably, the mid portion 52 of the bolt 18 is formed as a 17 to 20 mm diameter solid cylindrical bar stock. The bar stock has a substantially smooth exterior surface so as not to interfere with any yielding movement of the cone bolt 18 relative to the bore hole 14 in the event of a predetermined minimum yield force. Preferably, the entire surface of the cone bolt 18 is coated with a lubricant or release agent, to minimize any adhesion between the set resin 26 and the bolt 18.

Figure 5:
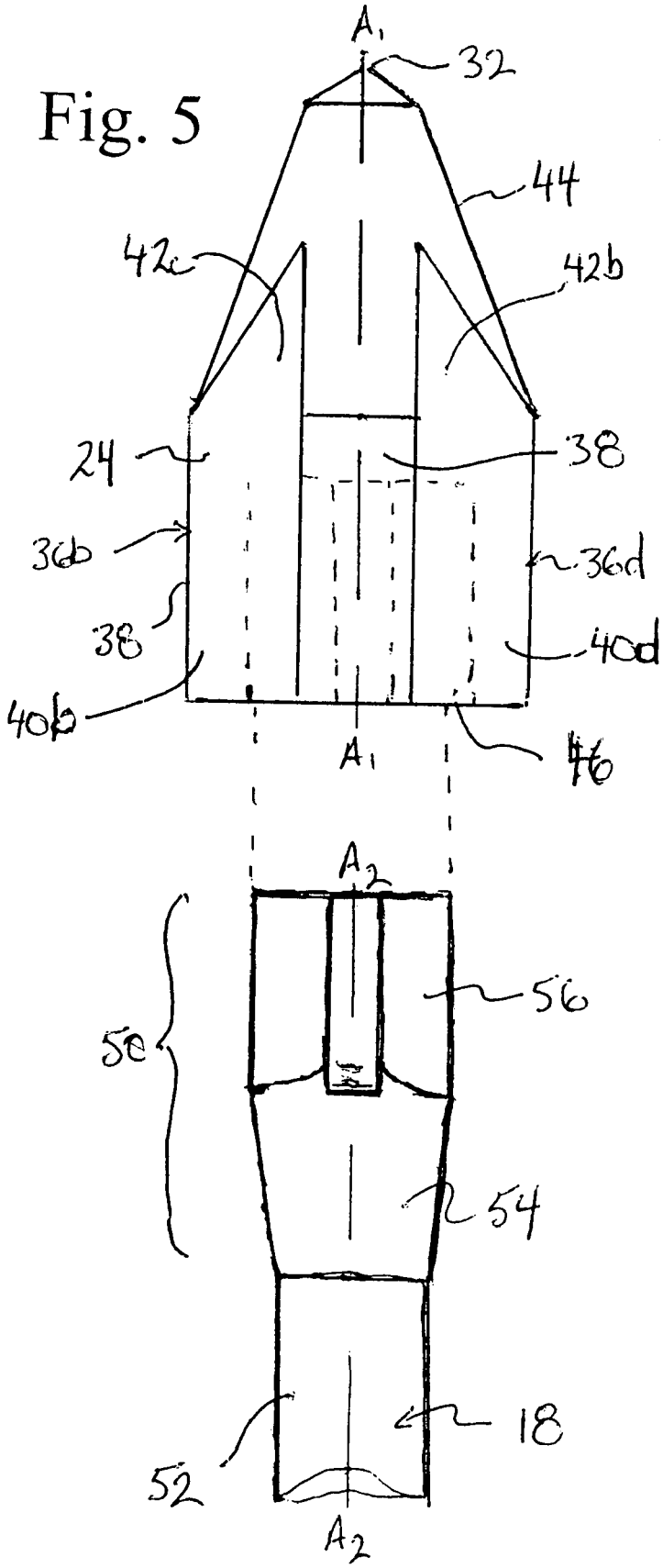
FIG. 5 shows an enlarged exploded view illustrating the attachment of the mixing head shown in FIG. 1 on the cone bolt of FIG. 4.

FIGS. 4 and 5 show best the distal end portion 50 of the bolt 18 as including a frustoconically shaped wedge member 54 which mergers at its distalmost end with an axially projecting tongue 56. The wedge member 54 extends radially outwardly from the axis $A_2$-$A_2$ from its proximalmost reduced diameter end to an enlarged distalmost end, with a maximum radial diameter selected at about 25 mm. The tongue 56 is secured to the distalmost end of the wedge member 54 by either welding or optionally forging, so as not to extend radially therepast where it may otherwise interfere with axial movement of the bolt 18 in the event of yielding movement. In a preferred construction, the tongue 56 is provided with a generally cross-shaped cross-sectional profile which mirrors that of the socket 46 formed in the mixing head 24. With this construction, the tongue 56 is adapted for mated insertion in the socket 46 in a complementary plug-fit manner. The insertion of the tongue 56 into the socket 46 secures the mixing head 24 to the distalmost end portion 50 of the cone bolt 18 in a friction-fit, with the body axis $A_1$-$A_2$ in co-axial alignment with the bolt axis $A_2$-$A_2$. Preferably, the tongue 56 has an axial length selected at between about 1 and 2 cm, however, longer or shorter tongues may be used.

FIGS. 7 and 8 show best the cast steel dome nut 20 for use in the mine roof support system 10. For ease of manufacture, the dome nut 20 is preferably formed from cast iron or steel, or alternately may be formed of a two-part construction consisting of high alloy steel body. In the embodiment shown, the nut body has generally a flattened square configuration with two opposing pairs of parallel side surfaces 60 which act as gripping portions of the nut 20. Although not essential, most preferably, the side surfaces 60 of the nut each have a size selected so as to present a planar surface area which is at least one square inch for every 55 ft. lbs. of torque to be applied to the nut 20 to achieve predetermined minimum threshold torque necessary to tension the bolt 18, and more preferably at least one square inch of surface area for every 30 ft. lbs. of torque required. As shown best in FIGS. 7 and 8, the nut 20 is further provided with a dome shaped end cover 62, and an internally threaded bore 64 which extends partway through and into the domed end cover 62.

The internal threads of the bore 64 are configured for complementary threaded engagement with the external threads of the proximal end portion 48 of the cone bolt 18. The domed end cover 62 has a thickness selected so that upon the application of a predetermined threshold minimum torque on the nut 20, the proximal-most tip 58 of the cone bolt 18 is moved into bearing contact against the middle of the domed end cover 62 causing it to split, and thereafter allowing the nut 20 to be threaded along the proximal end portion 48 to a tightened position against the face 66 of the rock complex 12, as shown in FIG. 8.

The resin cartridges 22*a*, 22*b* are preferably of a two-part low viscosity resin such as that sold by Dupont under the trade mark CONELOC™. The applicant has appreciated that in the case of smaller diameter bore holes 14, the use of lower viscosity resins advantageously ensures better resin flow along the resin flow channels 42*a*, 42*b*, 42*c*, 42*d*, outwardly past the mixing head 24, enabling even distribution of the resin 26 about the distal end portion 50 of the bolt 18, minimizing the likelihood of bolt failure.

In installation, a 3 to 5 cm diameter bore hole 14 is drilled to a desired depth into the rock complex 12, having regard to the length of the bolt 18 to be installed, and which typically extends between about 1.5 to 2.5 meters from the rock face 66. A number of two-part resin cartridges 22*a*,22*b* (shown in FIG. 6) are slid axially into the bore hole 14 ahead of the mixing head 24 and bolt 18. Although not essential, prior to the insertion of the cone bolt 18, the bolt 18 is preferably pre-coated for use, whereby grease is applied as a release agent over the distal and mid portions 50,52 of the bolt 18. A steel reinforcing plate 68 (FIG. 8) is optionally positioned along the proximal end 48 of the bolt 18, and the dome nut 20 is then threaded over the proximal tip 58 and into threaded engagement with the exterior threads of threaded proximal end 48. The dome nut 20 is threaded onto the bolt 18 so that the distal tip 58 is moved relative thereto to a position seated against the interior of the dome end cover 62.

Once the dome nut 20 and plate 68 have been placed, the mixing head 24 is then secured to the distalmost end portion 50 of the cone bolt 18 by axially aligning the axis $A_1$-$A_1$ of the body 30 with the bolt axis $A_2$-$A_2$ and inserting the tongue 56 into the socket 46, as for example is shown in exploded view in FIG. 5. Preferably, the complementary fit of the tongue 56 within the socket 46 retains the mixing head 24 on the cone bolt 18 in a friction-fit manner.

The mixing head 24 and distalmost end portion 50 of the cone bolt 18 are then inserted as a single unit into the bore hole 14. As the cone bolt 18 is slid inwardly, the cone-shaped distal portion 31 of the mixing head 24 engages and pierces the cartridges 22*a*, 22*b* and effects initial mixing of the dispersed resin 26. To enhance mixing of the unset resin 26, as the cone bolt 18 is inserted, it is preferably concurrently rotated about its longitudinal axis $A_2$-$A_2$ by driving the dome nut 14 in rotation on the proximal end of the bolt by way of a socket drive or power wrench (not shown). As the mixing head 24 is moved further inwardly into the bore hole 14, the unset resin 26 flows therepast along the respective resin flow channels 46*a-d*, to flow about and encase the distalmost end portion 50 of the cone bolt 18. The applicant has furthermore appreciated that the positioning of the tongue 56 within the socket 46, and the comparatively larger diameter D of the mixing head 24 advantageously further acts to assist in ensuring that the cone bolt 18 is axially centered within the resin 26 and bore hole 14. As the cone bolt 18 is rotated together with the nut 20 about its axis $A_2$-$A_2$ within the unset resin 26, the engagement of the tongue 56 within the socket 46 effects rotation of the mixing head 24 about its axis $A_1$-$A_1$ to effect further resin mixing by the mixing blades 36*a-d*.

Following mixing of the resin 26, the rotation of the nut 20 is stopped and the resin 26 is permitted to set, securing both the mixing head 24 and the cone bolt 18 within the bore hole 14. Following the setting of the resin 26, the dome nut 20 is rotated with a torque force exceeding the predetermined minimum rotational force necessary to deform the dome shaped cover end 62, and preferably which is selected at between about 40 ft/lbs and 140 ft/lbs, and more preferably between about 50 ft/lbs and 80 ft/lbs. The engagement of the mixing blades 36*a-d* with the set resin 26 prevents further rotation of the mixing head 24 about its axis $A_1$-$A_1$ after the resin has set. Furthermore, the mated engagement between the cone bolt tongue 56 within the socket 46 results in the mixing head 24 further securing the cone bolt 18 against rotation about its axis $A_2$-$A_2$ as the dome nut 20 is tightened. The threaded engagement between proximal end portion 48 with the internal threads 64 of the nut 20 enables the nut 20 to be tightened towards the distalmost portion 50 and the distortion of the domed end cover 62. In a conventional manner, as the dome shaped cover 62 distorts and deforms, the nut 20 is allowed to run along the threaded end portion 48 so as to be tensioned against the support plate 68 and rock face 66.

Figure 9:
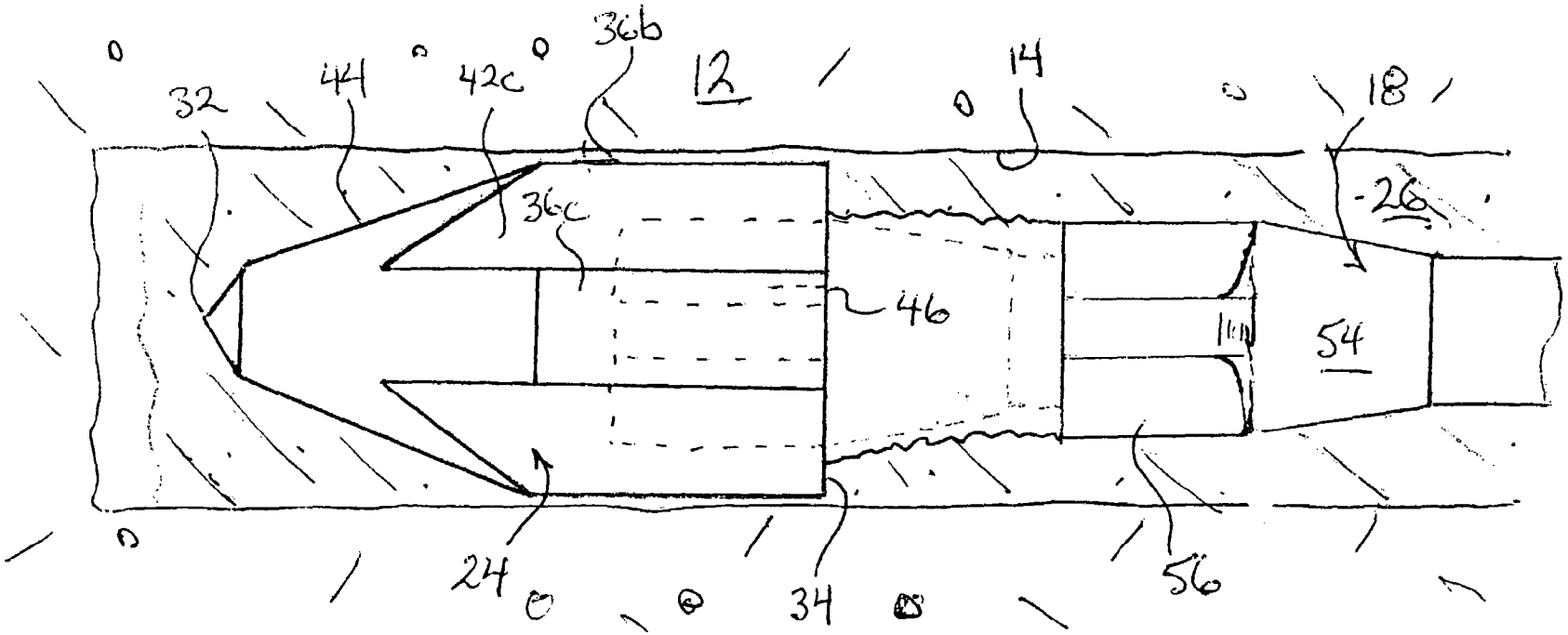
FIG. 9 illustrates schematically the relative positioning of the mixing head and the inner distal end of the cone bolt in the set resin, following yielding movement of the cone bolt subsequent to the application of a predetermined minimum yield force thereon.

Initially, once the resin 26 sets, the tongue 56 of the cone bolt 18 remains positioned fully seated within the socket 46 as shown in FIG. 8 and in phantom in FIG. 9, and wherein set resin 26 fully encases and encircles the frustoconical wedge member 54 and mixing head 24. In the event that rock forces in the rock complex 12 exceed a predetermined minimum yield force of the bolt 18, the cone bolt 18 is drawn axially so as to move outwardly from the bore hole 14 through the set resin 26. The engagement between the set resin 26 and the cone shaped wedge member 54 of the bolt 18 absorbs the energy of the dilating rock until the bolt 18 moves to the position shown in solid lines where, for example, equilibrium is returned. It is to be appreciated that because the mixing head 24 is secured to the cone bolt tongue 56 in a plug-fit, the mixing head 26 does not interfere with yielding movement of the cone bolt 18 as it moves axially outwardly from the bore hole 14. As such, the yielding force results in the tongue 56 unplugging from the mixing head 24 and the bolt 18, simply sliding outwardly from the bore hole 14 relative to the mixing head 24, while the mixing head 24 remains in its original fixed place.

Although FIGS. 1 to 9 describe the invention as including a mixing head 24 adapted for securement to a cone bolt 18, the invention is not so limited. It is to be appreciated that the mixing head 24 of the present invention is equally suited for a variety of different types of anchor rods and bolts used in wall and/or mine roof support applications, including conventional grouted and/or resin anchored rods.

Although the preferred embodiment of the invention describes the bolt tongue 56 and socket 46 as having a complementary cross-shaped cross-sectional profile, the invention is not so limited. It is to be appreciated that the socket 46 and tongue 56 could have different axial lengths and/or cross-sectional profiles from those shown, or from each other. Suitable profiles would include by way of non-limiting example, cross-sectional profiles which are generally square, rectangular, oval shaped or crescent shaped to name but a few.

Figure 10:
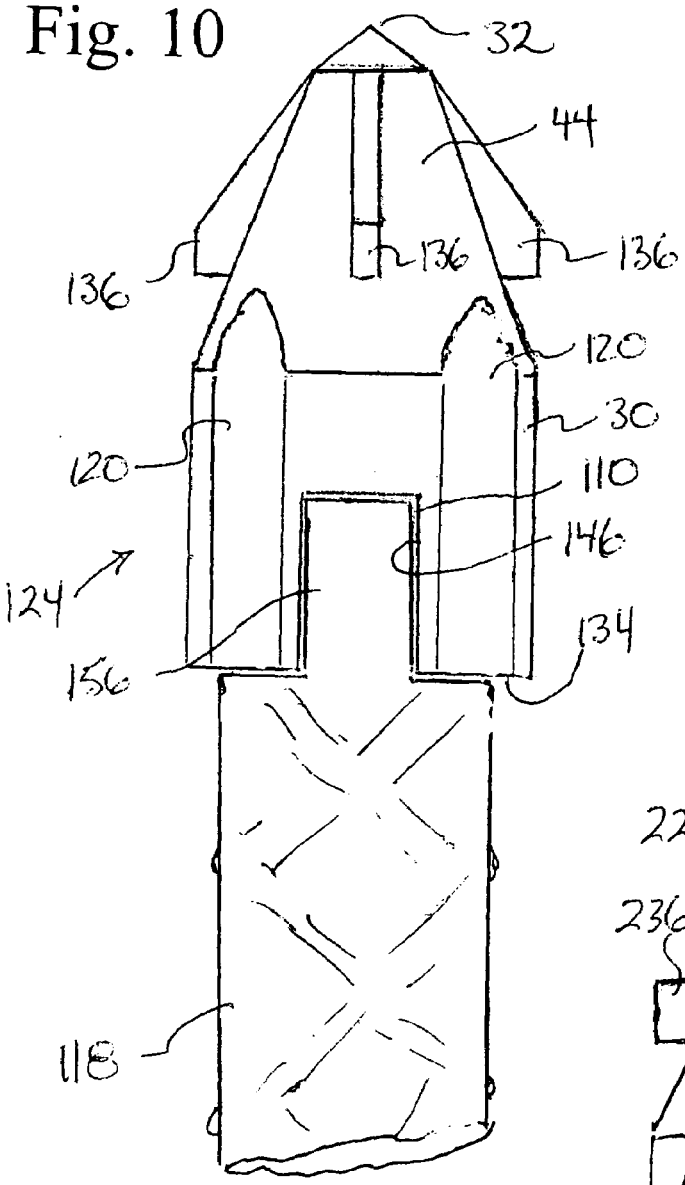
FIG. 10 illustrates a schematic side view of a mixing head in accordance with a second embodiment of the invention, illustrating its securement to a rebar-type anchor rod in accordance with a second embodiment of the invention.

Reference may be had to FIG. 10 which illustrates a mixing head 124 secured to the distalmost inner end of a conventional steel anchor rod 118 in accordance with a further embodiment of the invention, in which like reference numerals are used to identify like components. In FIG. 10, the anchor rod 118 is provided at its distalmost end with a generally rectangular ground or crimped steel tongue 156. The tongue 156 projects axially from a remainder of the anchor rod 118 and is configured for insertion within a slot 146 which extends laterally through the end surface 134 of the mixing head body 30. A layer of adhesive 110 is provided within the slot 146 to assist in physically coupling the mixing head 124 to the anchor rod 118. The body 30 is provided as a generally spear-shaped tip configuration which includes four radially projecting flanges 136. The flanges 136 function as mixing blades to assist in mixing unset resin. The proximal end portion of the mixing head 124 is provided with a generally cylindrical construction and which includes a series of flutes or resin flow grooves 120, and which facilitate the flow of unset resin axially past the mixing head 124 which extend axially there along.

Figure 11:
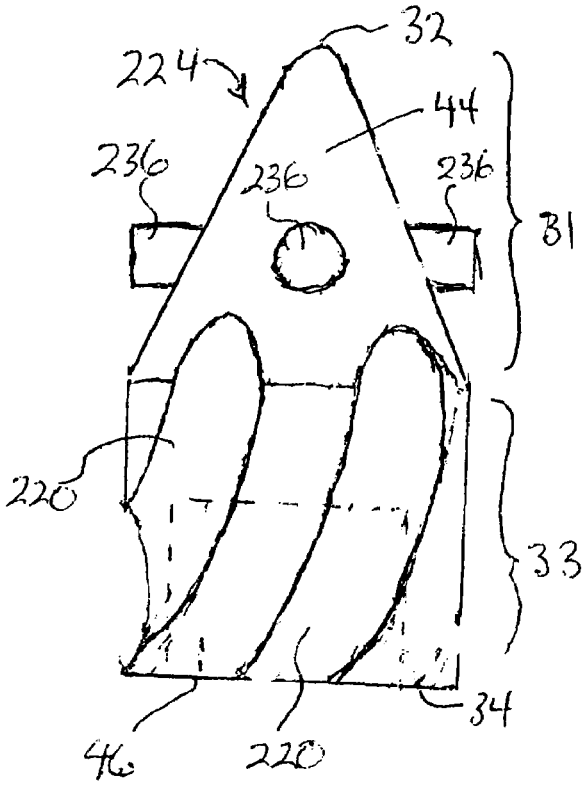
FIG. 11 illustrates schematically a mixing head for use in a mine roof support system in accordance with a further embodiment of the invention.

Although FIGS. 1 to 3 illustrate a detachable mixing head 24 which includes four identical and equally spaced mixing blades 36*a*, 36*b*, 36*c*, 36*d*, the invention is not so limited. It is to be appreciated that in an alternate construction, a mixing head 24 may be provided which includes resin mixing blades or projections of differing types and shapes at random or equal spacing about the body 30. FIG. 11 illustrates a mixing head 224 in accordance with a further embodiment of the invention in which like reference numerals are used to identify like components. In FIG. 11, the socket 46 is provided having a generally rectangular cross-sectional profile. A series of cylindrical projections 236 are provided in place of planar mixing blades for mixing unset resin. In FIG. 11, resin grooves 220 are provided with a generally helical orientation, extending from the tapered distal end portion 231 of the body 30 to the end surface 34, to better facilitate resin mixing.

Although the preferred embodiment of the invention describes the mixing head 24 as having a diameter D which is selected less than the diameter of the bore hole 14, the invention is not so limited. It is to be appreciated that in alternate constructions where, for example, the mixing head body 30 or the mixing blades 36 are made of less rigid materials so as to be bendable or flexible, the body 30 could be provided with a maximum diameter which exceeds that of the bore hole 14, so as to effect scraping contact between blade members and bore hole sides for still enhanced resin mixing.

Although the preferred embodiment of the invention describes the mixing head as being used in conjunction with a mine roof support system 10, the invention is not so limited. It is to be appreciated that the mixing head 24 may be used with grout or resin anchored anchor rods in a variety of support applications, including without restriction as part of rock or concrete wall reinforcing systems and the like.

While the detailed description describes the mixing head 24 as being formed with an integral cast aluminum construction, other configurations are also possible. By way of non-limiting example, the mixing head 24 could equally be formed as a single integral cast iron, steel or other metal construct. Alternately, cast fiber reinforced or non-fiber reinforced plastic or graphite constructions could also be used. In a less preferred construction, the mixing head 24 could be made of a multi-component construction in which mixing blades 34 or projections are physically secured to a remaining portion of the body 30 by welding, adhesives, or in a mechanical-fit arrangement.

Although the preferred embodiment of the invention describes a mine roof support system 10 as including a low viscosity two-part resin, the invention is not so limited. It is to be appreciated that the present invention may be used in the mixing of other high or low viscosity grouts and resins, without departing from its spirit and scope.

While the detailed description describes the use of a dome nut 20 used to spin the anchor rod in the mixing of the unset resin 26, the invention is not so limited. Other types of fasteners used to spin and/or tighten the anchor bolts or rods may also be used, including without restriction, pin nuts, crimped nuts and/or tensioning nuts having detachable cap members.

Although the detailed description describes and illustrates various preferred embodiments, the invention is not so limited. Many modifications and variations will now appear to persons skilled in the art. For a definition of the invention, reference may be had to the appended claims.

We claim:

1. A mixing attachment for use in mixing resin used in the securement of an anchor bolt in a bore hole, the mixing attachment comprising, a body extending longitudinally along an axis from a first end portion to a second end portion, and including, at least one blade member, including at least one associated mixing face extending generally radially relative to said axis, said mixing face configured to assist in mixing said resin as said mixing attachment is rotated about said axis, a recess formed in said second end portion sized for complementary mated engagement with a distal end of said anchor bolt, said recess configured to couple said mixing attachment to said distal end with a minimum contact force selected so that prior to the setting of said resin, the rotation of the anchor bolt in said bore hole effects rotation of said mixing attachment about said axis, while permitting relative axial movement between said body and said anchor bolt upon the application of a predetermined minimum yield force, so as not to substantially interfere with yielding axial movement of the anchor bolt in said bore hole.

2. The mixing attachment of claim 1 wherein said first end portion of said body is generally tapered and extends radially inwardly towards said axis towards a distal-most end.

3. The mixing attachment of claim 1 wherein said body comprises a plurality of said blade members, the associated mixing face of each of said blade members extending in a plane generally parallel to said axis.

4. The mixing attachment of claim 3 wherein each of said blade members are integrally formed with said body.

5. The mixing attachment of claim 1 wherein said anchor bolt is fixedly secured in said recess by an adhesive or welding.

6. The mixing attachment of claim 1 wherein the recess comprises a socket having a lateral cross-sectional profile selected from the group consisting of a generally square-shaped cross-sectional profile, a generally cross-shaped cross-sectional profile, a generally rectangular cross-sectional profile and a generally oval cross-sectional profile, and said distal end of said anchor bolt having a cross-sectional profile which is configured for complementary engagement with said socket.

7. The mixing attachment as claimed in claim 1 wherein the body is fluted in the axial direction.

8. The mixing attachment as claimed in claim 1 wherein the body comprises at least one resin flow groove extending from the first end portion to the second end portion, said groove being selected from an axially extending groove, and a generally helically extending groove.

9. The mixing attachment as claimed in claim 1 wherein said body is integrally formed from a material selected from the group consisting of a plastic, a graphite composite, aluminum and steel.

10. The mixing attachment as claimed in claim 1 wherein said body has a maximum radial diameter selected at between about 2 and 4 cm, an axial length selected at 5 and 10 cm, and said recess extends axially into said body a distance of at least about 1 cm.

11. The mixing attachment as claimed in claim 1 wherein the recess comprises a laterally extending slot.

12. A mine roof support assembly for use in a predrilled bore bole having a diameter selected at between 2 and 6 cm, the assembly comprising, an anchor bolt comprising a longitudinally elongated member which extends along a bolt. axis from a threaded proximal end portion to a distal end portion, and further including a mid-portion intermediate said proximal and distal end portions, the distal end portion including a frustoconical wedge member extending radially outwardly relative the bait axis from a reduced diameter proximal-most end to an enlarged diameter distal-most end, and a tongue member, a threaded fastener including, a fastener body having first and second ends, a generally cylindrical opening extending through said fastener body, internal threads being provided along at least a portion of said opening, the internal threads sized for threaded engagement with the externally threaded proximal end portion of the anchor bolt, whereby the relative rotational movement of the threaded fastener and the anchor bolt moves the threaded fastener axially along the anchor bolt, a retaining member for limiting axial movement of the threaded fastener relative to said anchor bolt from a first position up to a predetermined rotational torque, said retaining member at least partially obstructing said cylindrical opening to limit relative movement of said fastener along said proximal end portion, and a resin mixing head comprising a head body extending longitudinally along a head axis from a first end portion to a second end portion, and including, a plurality of blade members, said blade members including a respecting mixing face extending generally radially relative to said head axis and configured to assist in mixing resin in said bore hole as said mixing head is rotated about said head axis, a recess formed in said second end portion sized for engagement with said tongue member of said anchor bolt, said recess configured to couple said mixing head to said anchor bolt so as to be rotatable therewith about said head axis upon the application of rotational torque forces on said anchor bolt up to said predetermined rotational torque, while permitting relative axial movement between said head body and said anchor bolt in the event of a predetermined minimum yield force.

13. A mine roof bolt assembly as claimed in claim 12 wherein said tongue member has a cross-sectional profile selected from the group consisting of a generally rectangular profile, a generally square profile, a generally cross-shaped profile and a generally oval profile, said recess comprising a socket sized for substantially mated engagement with at least a portion of said tongue member.

14. A mine roof support assembly as claimed in claim 13 wherein said resin mixing head has a maximum radial diameter selected at least 90% as wide as said diameter of said bore hole.

15. A mine roof support assembly as claimed in claim 13 wherein said head body has a maximum radial diameter selected at between about 2 and 4 cm, an axial length selected at 5 and 10 cm, and said socket extends axially into said body a distance of at least about 1 cm.

16. A mine roof support assembly as claimed in claim 12 wherein the mixing face of each of said blade members comprises a face surface extending in a plane generally parallel to said axis.

17. A mine roof support assembly as claimed in claim 16 wherein the head body comprises at least one resin flow groove extending from said first end portion to said second end portion, said groove being selected from an axially extending groove, and a generally helically extending groove.

18. A mine roof support assembly as claimed in claim 16 said head body is integrally formed from a material selected from the group consisting of a plastic, a graphite composite, aluminum and steel.

19. In combination, an axially elongated anchor member and a mixing head for use in mixing resin used in the securement of an inner distal end portion of the anchor member in a bore hole, the mixing head comprising, a body extending longitudinally along an axis from a first end portion to a second end portion, and including a plurality of blade members, each blade member including a mixing face projecting generally outwardly relative to said axis and configured to assist in mixing said resin as said mixing head is rotated, a recess formed in said second end portion sized for complementary mated engagement with said distal end portion of said anchor member, said recess configured to couple said mixing head to said anchor member in generally co-axial alignment with sufficient contact force so as to be rotatable therewith about said axis under relative torque rotational forces of at least about 20 ft/lbs, the anchor member comprising a yieldable cone bolt, and wherein the recess is configured to allow axial movement of the cone bolt relative to the mixing head upon the application of a predetermined minimum yield force, so as not to substantially interfere with yielding movement of the cone bolt in said bore hole.

20. The combination as claimed in claim 19 wherein the mixing face of each said blade member extends in a plane generally parallel to said axis.

21. The combination as claimed in claim 20 wherein said socket extends axially into said body a distance of at least about 1 cm.

22. The combination as claimed in claim 19 wherein the recess comprises a socket having a lateral cross-sectional profile selected from the group consisting of a generally square-shaped cross-sectional profile, a generally cross-shaped cross-sectional profile, a generally rectangular cross-sectional profile and a generally oval cross-sectional profile, and said distal end of said anchor rod includes a projecting tongue member having a cross-sectional profile which is configured for complementary engagement with said socket.

23. The combination as claimed in claim 19 wherein said body further includes at least one resin flow channel selected from the group consisting of a radially extending groove, an axially aligned groove and a helically extending groove.

* * * * *